United States Patent [19]

King

[11] 4,084,125

[45] Apr. 11, 1978

[54] MOBILE SHELVING UNIT

[76] Inventor: James R. King, 6804 Capstan Dr., Annandale, Va. 22003

[21] Appl. No.: 717,462

[22] Filed: Aug. 24, 1976

Related U.S. Application Data

[63] Continuation-in-part of Ser. No. 578,893, May 19, 1975, abandoned.

[51] Int. Cl.[2] ..... A47B 53/00

[52] U.S. Cl. ..... 312/199; 312/201; 312/250

[58] Field of Search ..... 312/201, 198, 199, 250, 312/236, 221, 297

[56] References Cited

U.S. PATENT DOCUMENTS

| | | | |
|---|---|---|---|
| 275,616 | 4/1883 | Elward | 312/201 |
| 566,010 | 8/1896 | Norkus | 312/250 |
| 617,021 | 1/1899 | Hunt | 312/201 |
| 1,299,302 | 4/1919 | Cottrell | 312/221 |
| 2,166,704 | 7/1939 | Foulkes | 312/199 |
| 3,351,405 | 11/1967 | Ferdinand et al. | 312/297 |
| 3,712,667 | 1/1973 | Weber | 312/250 |
| 3,712,697 | 1/1973 | Kelley et al. | 312/297 |
| 3,868,123 | 2/1975 | Berg et al. | 312/250 |
| 3,905,662 | 9/1975 | Richmond | 312/198 |

FOREIGN PATENT DOCUMENTS

| | | | |
|---|---|---|---|
| 1,441,681 | 5/1966 | France | 312/199 |
| 1,262,305 | 4/1961 | France | 312/199 |
| 598,333 | 9/1959 | Italy | 312/250 |
| 617,152 | 2/1961 | Italy | 312/198 |
| 409,280 | 9/1966 | Switzerland | 312/250 |

*Primary Examiner*—Paul R. Gilliam
*Assistant Examiner*—Victor N. Sakran
*Attorney, Agent, or Firm*—Lowe, King, Price & Markva

[57] ABSTRACT

A shelving system is provided utilizing elongated shelf assemblies or units with at least one of the assemblies being provided with rollers supported on a flat surface or floor to allow movement in the lengthwise direction. Standard shelving units with corner posts rest on a plurality of platform mounted rollers. Side access openings of the shelf assemblies face each other so that a fully closed system is formed when the assemblies are pushed together. When opened, sufficient space between the adjacent corners of the assemblies allows full unobstructed access to the shelves of both. Groups of juxtaposed rollers are positioned on at least two axles carried by inverted U-shaped frames at each of the corners. The corner posts of the assemblies are connected by the horizontal shelves and paneling or sheet steel serves to close and reinforce the assemblies. The system embodies a modular concept so that groups of two or three units may be provided. When multiples of four or six units are used, preferably the middle two units are stationary and connected together. To insure proper guiding, rails with a beveled lead in edge are provided on the stationary units adjacent the floor to engage the edge of the outer rollers. A hasp and lock secures the movable unit to the stationary unit to prevent access to the shelves.

14 Claims, 17 Drawing Figures

FIG. 4
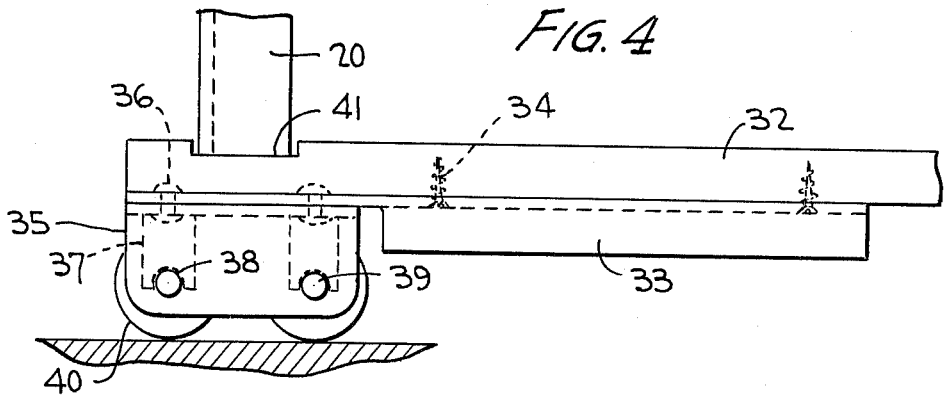
FIG. 5
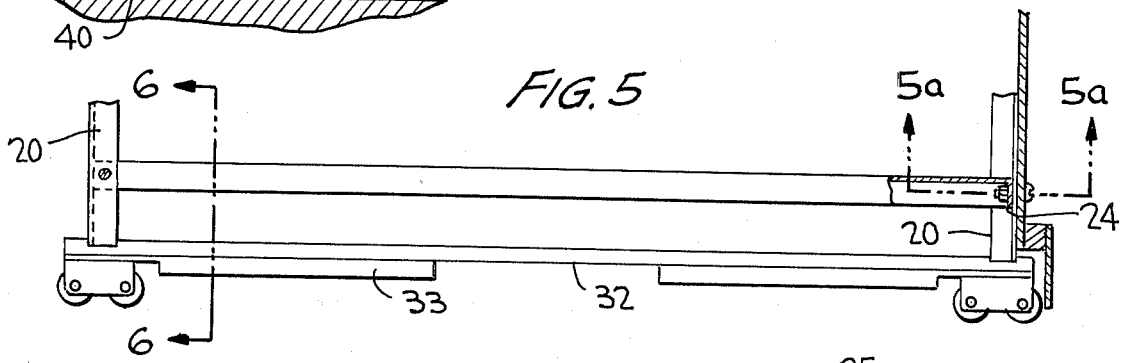
FIG. 6
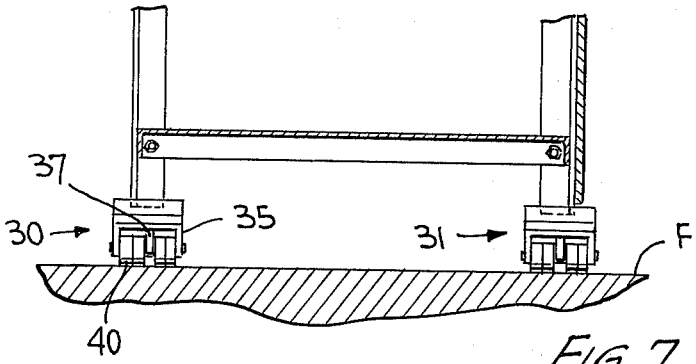
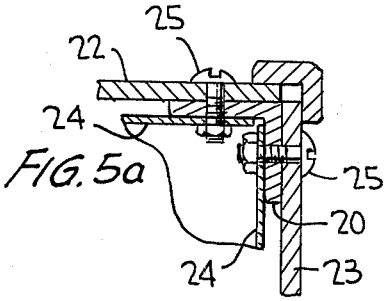
FIG. 5a
FIG. 7
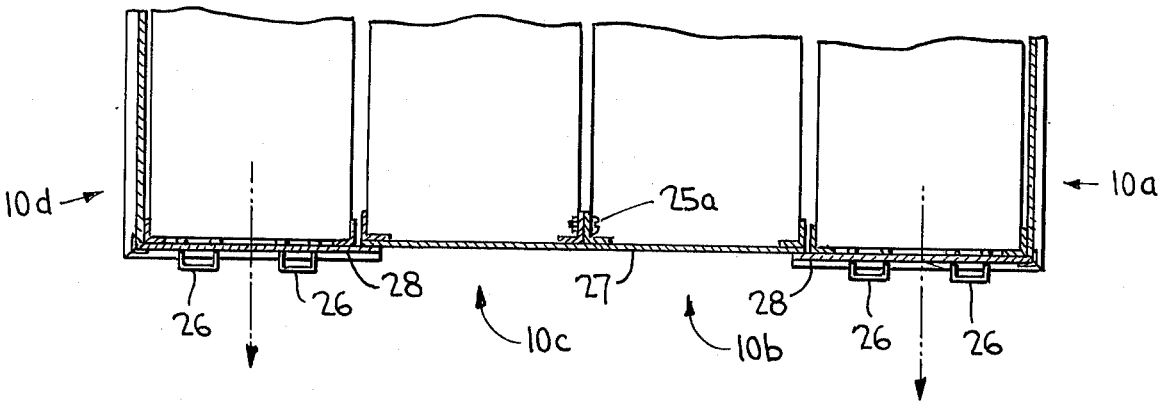

MOBILE SHELVING UNIT

This is a continuation-in-part of my earlier application Ser. No. 578,893, filed May 19, 1975, now abandoned.

FIELD OF THE INVENTION

The present invention relates to modular storing systems, and more particularly, to a shelving system wherein at least one of a plurality of the shelving units is mobile for greater space utilization.

BACKGROUND OF THE INVENTION

There are several modular shelving systems on the market today wherein any desired number of shelving units are positioned in a group depending on the amount of storage needed. In order to conserve space, one or more of the shelving units may be mobile. Typically, each mobile unit is provided with rollers that roll on tracks permanently secured to the floor.

In one of the most popular systems on the market, the shelving units move laterally (sideways) rather than in the longitudinal direction. In a system of this nature, access to a particular shelf assembly is hampered since in most instances more than one of the assemblies must be moved. Also, there is always one shelf assembly left open and thus neither a fully closed system nor full space utilization is attained.

A similar type of system has been proposed in the prior U.S. Patent to Foulkes U.S. Pat. No. 2,166,704, issued July 18, 1939. This system has essentially the same drawbacks of being track supported, not being capable of being fully closed and not making full utilization of floor space.

Thus, there is a need first for a shelving system that operates on a flat surface without the need for the expensive track system used by the prior art. When a track system is provided, the purchaser is faced with either providing a false floor and ramp in order to conceal the tracks, or leaving the tracks exposed providing a safety hazard. Secondly, there is a need for a system that can be fully closed when the units are positioned in juxtaposition. Only one unit for every two or three should have to be movable for access to any shelf in the system. Such a system is not only more aesthetically pleasing and more secure, but also maximizes utilization of floor space and is lowest in cost.

OBJECTIVES OF THE INVENTION

Accordingly, it is a main object of the present invention to provide a mobile shelving system that is low cost, safe to use and efficient.

It is another object of the present invention to provide a shelving system that utilizes standard components for maximum economy and is guidable on a flat surface without an expensive and complicated track system.

It is still another object of the present invention to provide a mobile shelving system wherein access to any one shelf may be gained by movement of only one unit.

It is still another object of the present invention to provide a system of mobile shelving units wherein a fully closed system may be provided.

BRIEF DESCRIPTION OF THE INVENTION

The objectives of the present invention are obtained by providing standard shelf assemblies with side access openings and one unit of each two or three units being made mobile by providing a plurality of platform mounted rollers under each corner post of the shelving unit. The multiple, juxtaposed rollers advantageously do not need tracks in order to provide proper tracking during operation. In one embodiment, a plastic guide rail on the stationary unit is used to engage the side of the outer roller on the movable unit to correct any guiding discrepancy. Thus, the system is low cost, safer and can be used on any solid office floor surface.

The movement of the mobile assembly is in the direction of elongation of the assembly for greatest stability. The access openings face each other so that the movement of the one assembly provides access to the adjacent units of a two or three unit module. Since the rollers have free movement on the flat surface or floor, the mobile units may be pulled out any desired distance. This allows the required movement to give sufficient space between the corners of the assemblies to form, in effect, an open system with unobstructed access. At each corner, at least two groups of support rollers mounted on two axles carried by an inverted U-shaped frame assure accurate or true tracking without the need for an expensive underlying track system. The guide rails on the stationary unit are within the confines of the closed assembly and are used to make minor corrections as the movable unit is being pushed back into the closed position.

The exposed sides and ends of the mobile shelf assemblies are closed and substantially reinforced by paneling sheets. When a four unit system is provided, the first and fourth assemblies are mobile, with the middle or second and third assemblies being stationary and positioned permanently back-to-back with each other. On the second and third assemblies in such a case, only end paneling (single sheet) is required. In a six unit assembly, the second and fourth units are movable with units one, three, four and six stationary. The gap provided between each mobile and stationary unit is conveniently closed by a paneling extension strip along the side edge of the movable unit.

In an alternative embodiment, the closing and reinforcing means for the shelf units are in the form of painted sheet steel skin that is flexible in the longitudinal direction so that it can be shipped in a coil. The side panel is formed by two sheets with an H-connector in between. The corner posts cover the edges of the sheets for a finished look without external molding. The movable unit may be locked to one of the adjacent stationary units for security.

Still other objects and advantages of the present invention will become readily apparent to those skilled in this art from the following detailed description, wherein I have shown and described only the preferred embodiment and an alternative embodiment of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE DRAWINGS

FIG. 4 is an enlarged side view showing the supporting platform and rollers for engagement on the floor;

FIG. 5 is a full length showing of the platform on one side of the assembly and the attachment detail of one end of a shelf;

Figure 8:
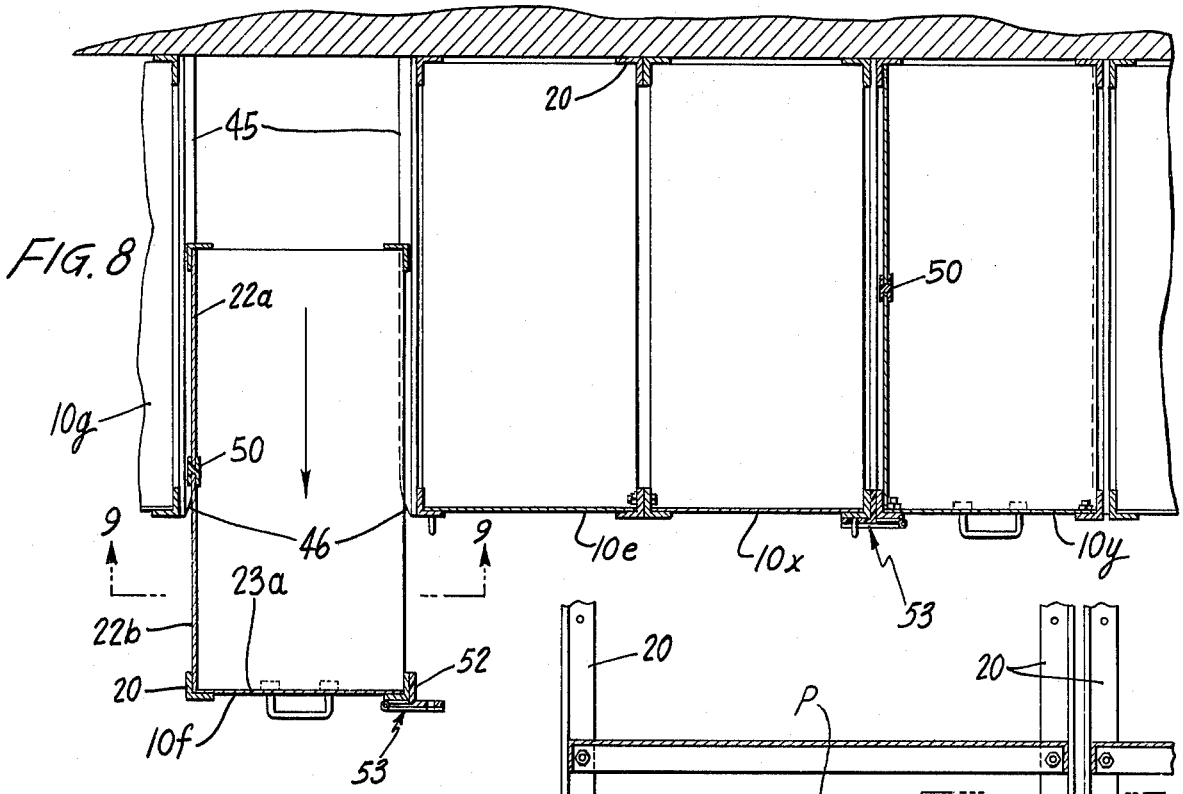
Figure 9:
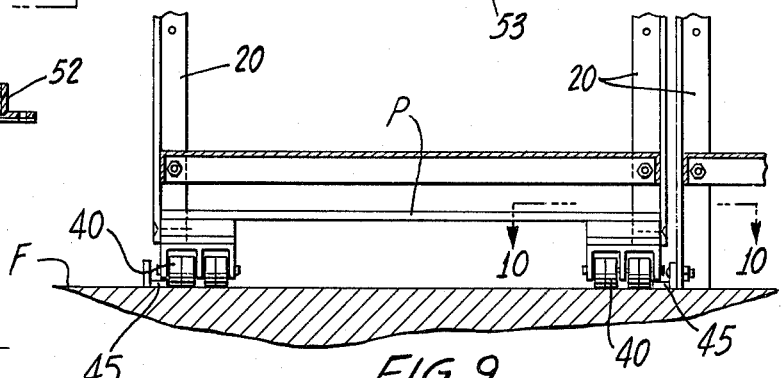
Figure 10:
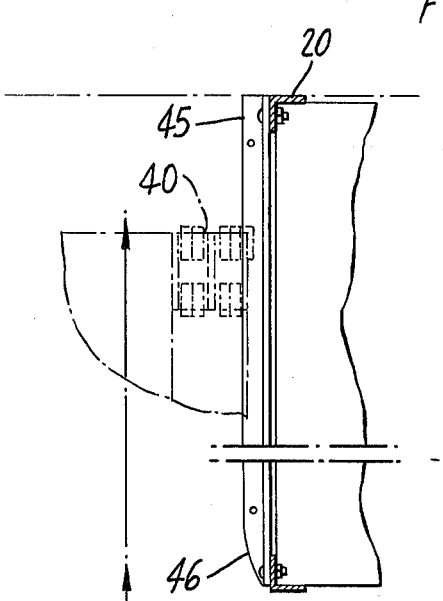
Figure 11:
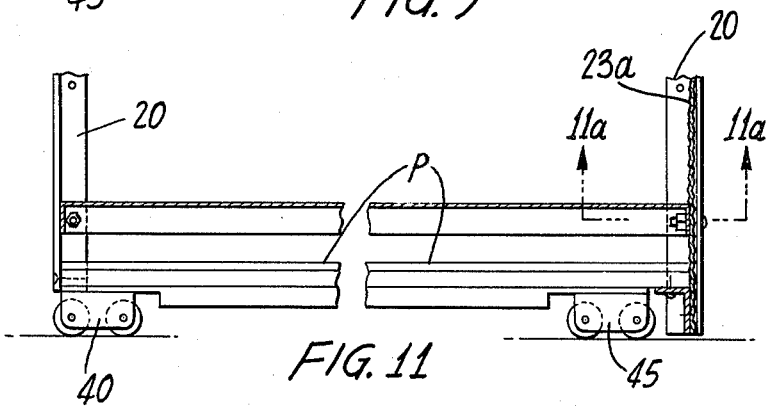
Figure 11A:
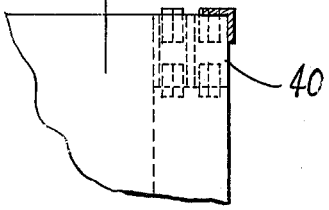
Figure 11A:
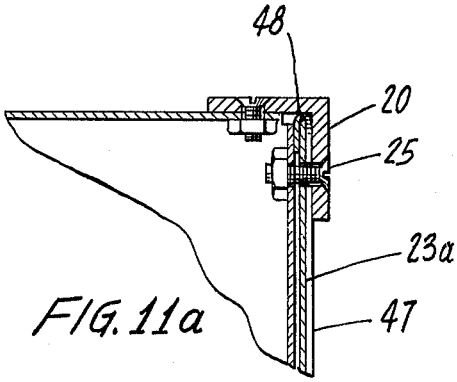
Figure 12:
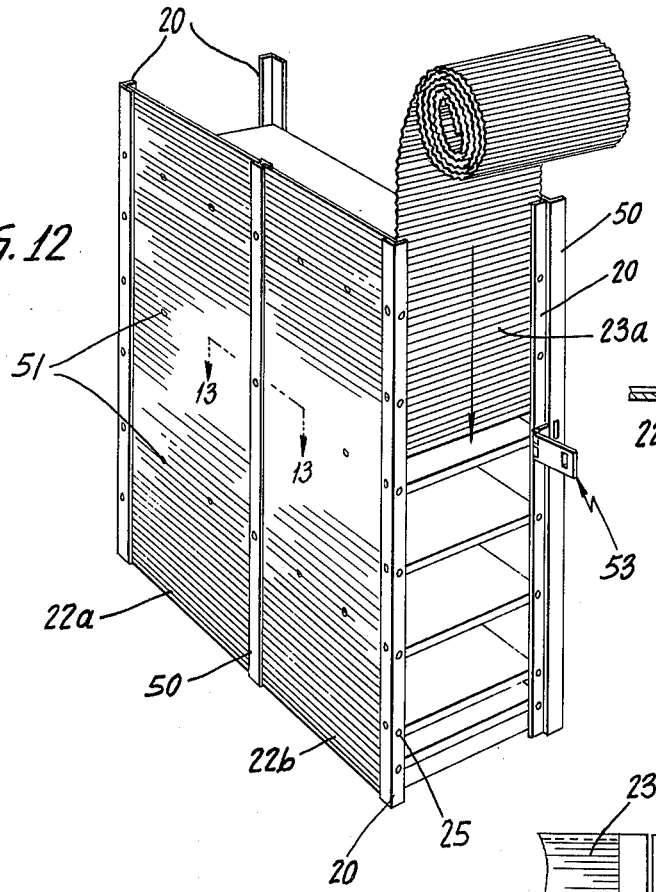
Figure 13:
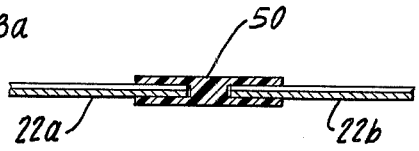
Figure 14:
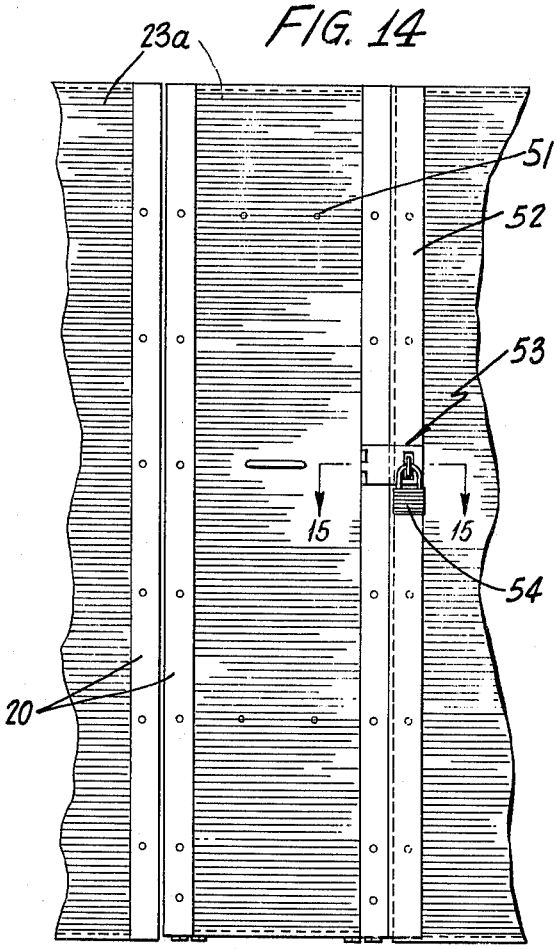

FIG. 5*a* is a cross-sectional view taken along line 5*a*—5*a* of FIG. 5 showing the interconnection between the horizontal shelves, vertical corner posts and paneling;

FIG. 6 is a cross-sectional view taken along line 6—6 of FIG. 5 showing an end view of the support platform and roller mounting;

FIG. 7 is a cross-sectional view taken in a horizontal plane showing the full closed configuration of the front of the system;

FIG. 8 is a sectional top plan view of the alternative shelving system utilizing three units per module;

FIG. 9 is vertical cross sectional view taken along line 9—9 of FIG. 8;

FIG. 10 is a cross sectional view taken through one corner of a unit along line 10—10 showing movement of the rollers;

FIG. 11 is a side cross sectional view;

FIG. 11*a* is an enlarged detail view of one corner of a unit;

FIG. 12 is a perspective view of the shelving system illustrating installation of the sheet metal skin from a roll;

FIG. 13 is a cross section showing the connection of two skins to form the side of a unit;

FIG. 14 is a detail view of the overlapping flap and lock between units; and

Figure 15:
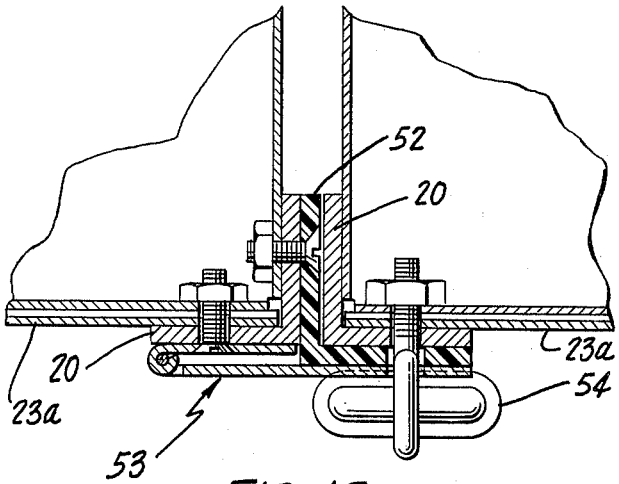

FIG. 15 is an enlarged view of the lock.

DETAILED DESCRIPTION OF THE PREFERRED EMBODIMENT

Figure 1:
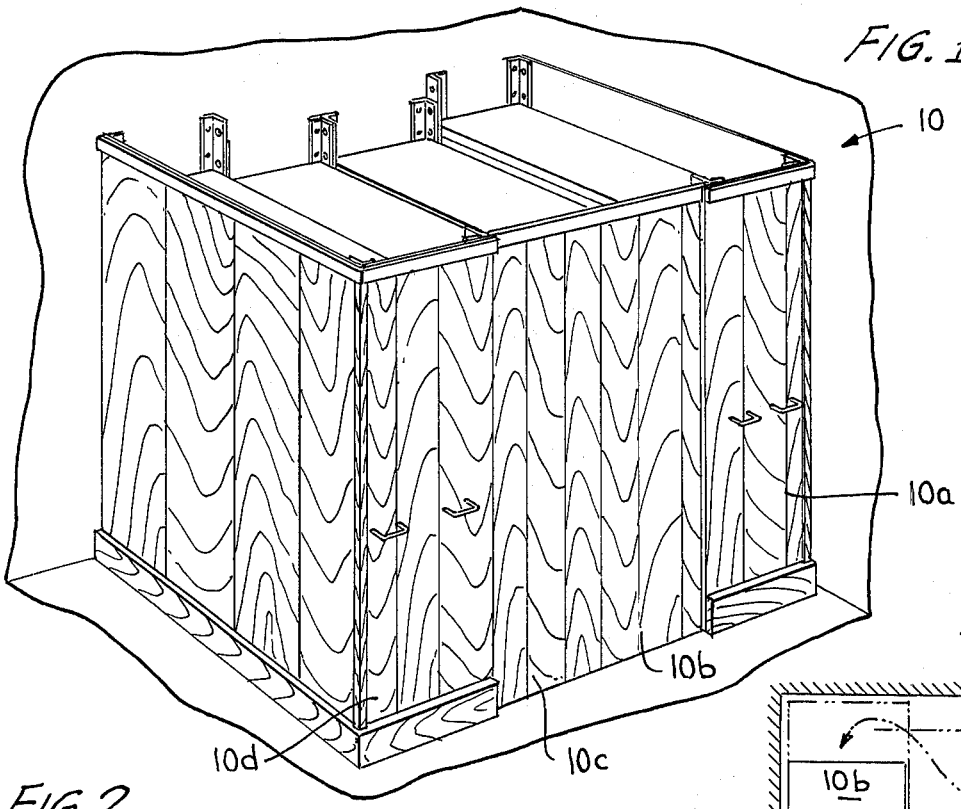
FIG. 1 is a perspective view of a mobile shelving system utilizing four units constructed in accordance with the principles of the present invention and in a closed mode.

With reference now to FIG. 1, a mobile shelving system 10, constructed in accordance with the principles of the present invention, includes individual elongated shelf assemblies 10*a*, 10*b*, 10*c* and 10*d*. As will be seen later in detail, the first and fourth assemblies 10*a*, 10*d* are mobile, whereas the center assemblies or units 10*b*, 10*c* are stationary.

The major required components of each of the assemblies 10*a*–10*d* includes four corner posts 20 (see FIGS. 2–7) and a plurality of horizontal shelves 21 attached to the posts 20. On the units 10*a*, 10*d*, side paneling or sheets 22 are fastened in position, whereas on the ends, paneling or sheets 23 are included. The shelves 21 have mounting ears 24 (see FIGS. 5 and 5*a*) and single fasteners 25 comprising a bolt and nut assembly serve to couple all of the parts together, i.e. the shelf 21, the corner post 20 and the paneling 22, 23 are all interconnected at each juncture by the fasteners 25.

The shelving combination of the corner posts 20 and the elongated horizontal shelves 21 preferably take the form of standard industrial shelving. The bolt and nut combination fasteners 25 are supplied with the standard units and accordingly the adaptation expense to the mobile shelving system of the present invention is minimized. The paneling sheets 22, 23 are preferably standard ¼ or 3/16 inch paneling sold in hardware stores, again with the result of minimizing the expense of the units. Importantly, since the bolt and nut combination fasteners 25 pass through the paneling sheets 22, 23, these serve the purpose of reinforcement of the shelving units. Standard handles 26 are provided along the end panels 23 in order to facilitate the movement of the units 10*a*, 10*d*.

The two center units 10*b*, 10*c* are stationary and a single paneling member 27 (see FIG. 7) is provided across the ends. The units 10*b*, 10*c* are positioned back-to-back and the two abutted corner posts are conveniently locked together by a single fastener bolt and nut combination 25*a* (see only one in FIG. 7). The end paneling sheets 23 on the mobile units have strip extensions 28 that overlap the crack between the mobile units 10*a*, 10*d* and the stationary units 10*b*, 10*c*, respectively. As shown in FIG. 1, when the units are positioned in juxtaposition, a substantially fully closed system with no access to the shelves is provided. If desired, a lock may be provided between the movable and stationary units in order to provide full security.

Figure 3:
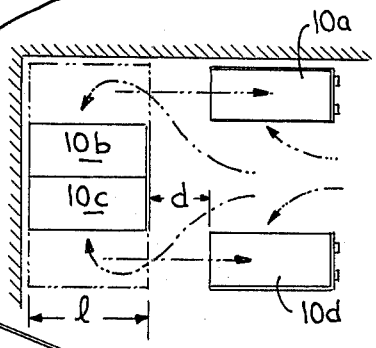
FIG. 3 is a plan view of the open arrangement of FIG. 2 illustrating the full unobstructed access to all units.
Figure 2:
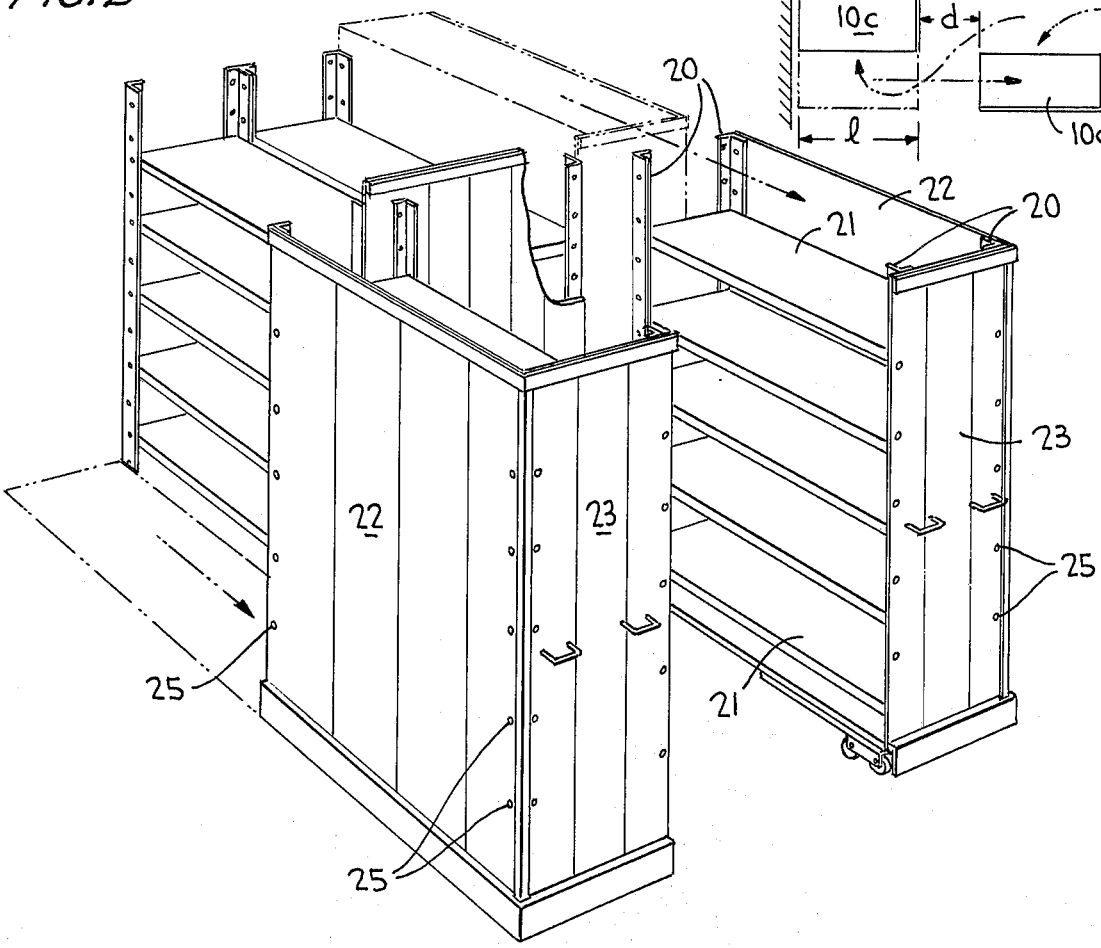
FIG. 2 is an enlarged perspective view with shelving units or assemblies moved for access to the open sides.

Thus, the concept of providing full closure of the system is a salient feature of the present invention. In FIG. 3, another important concept may be best visualized. This concept is concerned with the free access to the units when one or more of the mobile units 10*a*, 10*d* are pulled out. As noted by the dashed line arrows in FIG. 3, full access can be obtained to the opposed side access openings of the two adjacent units 10*a*, 10*b* and 10*c*, 10*d*. With the units 10*a*, 10*d* being free to be pulled out (a full length 1 plus a distance *d*) there is sufficient clearance for the user to proceed in the direction of the dotted line arrows. This gives access to the units 10*b*, 10*c* that is superior to that heretofore possible.

Particular note should also be made that there are no tracks along the dashed line paths to hinder or to provide a safety hazard. Furthermore, because the side access openings (note dashed line arrows) of the adjacent units are opposed to each other, with the movement of only one unit 10*a* or 10*d* back into juxtaposition with the corresponding stationary unit 10*b* or 10*c*, respectively, a full closure of the units can be effected. Although the distance *d* can vary with personal preference, a distance of at least 30 inches has been found to best meet the objectives of free access.

It should be emphasized that to gain access to either of the stationary units 10*b*, 10*c*, only one of the mobile units 10*a*, 10*d* (alternatively) must be moved. In prior arrangements where the shelves open in the same direction, movement of both units is required to gain access to the last in-line stationary unit positioned in the rear.

The multiple roller support for each corner of the mobile units 10*a*, 10*d* is a key to several of the objectives of the present invention. In FIGS. 4, 5, and 6, two spaced side platforms 30, 31 are shown for supporting the shelf assemblies 10*a*, 10*d*. Bascially, each of the platforms includes an elongated rail member 32 (see FIG. 5) that extends along the side of a unit and upon which the corner posts 20 directly rest. Reinforcing metal struts 33 are attached on the underneath side of the rails 32 by suitable fasteners 34 (see FIG. 4). Inverted U-shaped frames 35 are attached to the struts 33 by rivets 36 or the like. The frame 35 has a center support 37 (FIGS. 4 and 7) adapted to bear against both supporting axles 38, 39. At least four relatively small rollers 40 are positioned on each axle 38, 39. Since the weight of each corner post 20 is then distributed over eight rollers 40, the pressure on any one roller is minimized.

The juxtaposed rollers 40 provide significant advantages in causing the units 10*a*, 10*d* to be relatively true tracking over the flat surface or floor F (FIGS. 4 and 7). This is so since the composite roller side slip of all eight rollers working in concert balances out giving a resultant straight ahead or true tracking movement. The rollers are plastic for low cost manufacture, and for relatively easy individual lateral slipping to assure the true tracking operation on a relatively slick, hard surface floor. Each of the corner posts 20 is preferably positioned within a slight recess 41, but is otherwise merely free standing on the platform since the weight on the unit and the articles on the shelves 21 holds the assembly in position.

As best shown in FIG. 8 of the drawings, the alternative embodiment may include combinations of shelving units wherein one shelving unit of each module can cooperate with two stationary units. Shelving 10*e*, 10*f* and 10*g* combine to form a three unit module, as shown in the plan view of FIG. 8. Any number of additional stationary shelving units 10*x* and cooperating movable shelving units 10*y* may be added in combinations of two or three unit modules to fill out the space required. In the shelving units 10*e*–10*g*, 10*x* and 10*y*, the same components as used in the first embodiment are numbered the same with the addition of a suffix where a change has been made.

As shown in FIG. 9, this embodiment provides lateral guide plates 45 that extend along the base of the stationary units. These plates may take the form of one leg of plastic angle attached to the corner posts 20, as shown in this figure. The outside lateral face of the outermost wheels 40 of each group of rollers is engaged in order to provide any correcting guiding action that is necessary during final closing movement of the movable unit.

As best shown in FIG. 10, the guide plate 45 may include a lead-in portion 46 that is effective to cam the rollers slightly to the side if necessary as the closing operation is performed. Because of the plurality of rollers, this corrective action is minimal and it has been found that the change in tracking required is hardly noticable to the user. Since the roller is turning and engages an edge of the plate 45, and both parts are low friction plastic, the resistance to pushing the units is minimized.

FIG. 11 illustrates the concept wherein the rollers may be positioned inboard of the posts 20, if desired. In this instance, the weight of the posts 20 is transferred to the wheels by a support platform P on each unit. The wheels are positioned out of sight, without the need for a skirt. However, this advantage is gained only at the expense of the more ideal way to distribution of the weight directly over the rollers, as provided in the first embodiment.

Another important feature of this second embodiment, is the use of light weight, relatively thin corrugated sheet metal 23*a* with folded over edges 48 to form the skin of the shelving units. The sheet metal is preferably in the range of 0.30–0.50 millimeters thick and has corrugations 47, as shown in FIG. 11*a*. These corrugations provide for strength in the lateral direction but allow for the material to be rolled longitudinally to make a compact package for shipping.

FIG. 12 illustrates the manner in which the roll is fed between the opposing corner posts 20 during installation. Lateral edges 48 of the corrugating metal skin are folded over for further reinforcement and to eliminate sharp edges and are tucked under the outer edges of the corner posts 20, as best shown in FIG. 11*a*. When the metal has been threaded into position, the fasteners 25 are tightened so as to clamp the edges 48 in position and provide strength and rigidity to the shelving unit as well as serving as the closing means for the unit.

The side skin of the alternative embodiment is formed of two sections 22*a*, 22*b*, which may be the same dimensions as the skin 23*a*. These two skins are joined to make a single side panel by an H-shaped connector 50.

Additional fasteners 51 extend through the skins 22*a*, 22*b*, 23*a* into the depending flanges of the shelves in order to provide additional rigidity and fastening of the parts together.

An angle closing strip 52 may be provided along the mating corner post 20 of the movable shelving units in order to close the gap formed with the stationary units. A lock, in the form of a hasp, may be provided between the movable unit and the stationary unit so that access to all of the shelves on both the movable and stationary units is prevented when the lock is in place. A standard padlock 54 may be used to create the locking function (see also FIG. 15).

From the foregoing, it can be seen that a new mobile shelf assembly and mobile shelf system has been provided that is economic to manufacture and more efficient to use than prior arrangements. The system is low cost since standard items are used and expensive full track systems are not required. Guide plates 45 extending solely within the confines of the stationary units and out of the path of persons using the system provide any small corrective guiding action that is required during operation of the units. The system is adaptable, unlike prior art attempts, to a full closed configuration. Furthermore, to gain the open configuration, only one unit need be moved for access to any two or three units. For any given unit, there is no need to move several mobile units in concert, as before. The weight is concentrated at the corner posts 20 and the combination of the inverted U-shaped frame 35 and the groups of support rollers 40 supports the units on the flat surface F for substantially true tracking movement. Corrugated sheet metal skin 22*a*, 22*b*, 23*a* closes the units, provides reinforcement and may be shipped in a compact roll.

In this disclosure, there is shown and described only the preferred embodiment of the invention, but, as aforementioned, it is to be understood that the invention is capable of use in various other combinations and environment and is capable of changes or modifications within the scope of the inventive concept as expressed herein.

What is claimed is:

1. A closed mobile shelving system for support on a flat surface comprising a first elongated shelf assembly having only a single one of its sides forming a side access opening, a second elongated shelf assembly having at least a single one of its sides forming a side access opening opposed to the opening of said first assembly, anti-friction means on one of said assemblies positioned to engage said flat surface to allow movement of said one assembly in its lengthwise direction, the other of said assemblies being stationary, means to close said first and second assemblies to form a closed system with substantially no access to the shelves when said assemblies are positioned in juxtaposition, said one assembly being free to separate with sufficient space between the corners of the assemblies to form an open system with full unobstructed access to both openings, and guide means extending longitudinally only along substantially the longitudinal extent of one of said assemblies.

2. The system of claim 1 wherein is provided platform means extending under at least said one assembly, said anti-friction means comprising a plurality of groups of non-pivotal support rollers mounted on said platform for straight line tracking on said flat surface.

3. The system of claim 1 wherein said guide means includes a flat plate portion adjacent said flat surface along the base of said stationary assembly, the plate having a guide edge serving to engage said anti-friction means to center said one assembly and a beveled edge forming a lead-in portion adjacent the outer edge of said stationary assembly.

4. The system of claim 2 wherein said groups of rollers each include a separate plurality of juxtaposed rollers on said platform means at each corner of said assembly to provide substantially true straight line tracking on said flat surface.

5. The system of claim 4 wherein said platform means includes an inverted U-shaped frame positioned under each corner at least two axles connecting the open side of said frame, and a separate plurality of juxtaposed rollers mounted on each axle.

6. The system of claim 5 wherein said platform means further includes a connecting rail member extending along one side of said assembly, said member being attached to at least the two frames at the spaced corners.

7. The system of claim 5 wherein said one assembly includes corner posts freely resting on said frames.

8. The system of claim 1 wherein the movable assembly is the first assembly, said second assembly being stationary with access gained solely by moving the first assembly.

9. The system of claim 8 wherein is provided third and fourth assemblies, the third assembly being stationary and positioned back-to-back with the second assembly, the fourth assembly being movable like the first and in juxtaposition to the third, said closing means on the assemblies including a relatively thin sheet over the exposed areas and for reinforcement.

10. The system of claim 1 wherein said closing means is metal sheet having traverse corrugations to resist lateral bending but to allow forming a roll along the longitudinal axis prior to assembly and clamp means to fix said sheet in position.

11. The system of claim 10 wherein said closing means further includes extension strip portions over the exposed spacing between said assemblies.

12. The system of claim 1 wherein is provided lock means extending between said assemblies to hold said one assembly from movement to prevent access to the shelves.

13. The system of claim 1 wherein said anti-friction means include rollers made of plastic and said guide means includes a plastic plate portion with the edge serving to guide the rollers by engagement with the outside lateral face.

14. The system of claim 1 wherein the assemblies include relatively thin sheet skin on the closed side and one end, and clamp means connecting each juncture of the corner posts, horizontal shelves and sheet skin.

* * * * *